US010213633B2

(12) United States Patent
Charles

(10) Patent No.: US 10,213,633 B2
(45) Date of Patent: Feb. 26, 2019

(54) STORED ENERGY FOR FAILSAFE VALVE

(71) Applicant: Siemens Industry, Inc., Alpharetta, GA (US)

(72) Inventor: Donald E. Charles, Wauconda, IL (US)

(73) Assignee: Siemens Industry, Inc., Alpharetta, GA (US)

( * ) Notice: Subject to any disclaimer, the term of this patent is extended or adjusted under 35 U.S.C. 154(b) by 0 days.

(21) Appl. No.: 15/549,571

(22) PCT Filed: Mar. 23, 2015

(86) PCT No.: PCT/US2015/021955

§ 371 (c)(1),
(2) Date: Aug. 8, 2017

(87) PCT Pub. No.: WO2016/153473

PCT Pub. Date: Sep. 29, 2016

(65) Prior Publication Data

US 2018/0036564 A1 Feb. 8, 2018

(51) Int. Cl.

| | |
|---|---|
| ***A62C 2/24*** | (2006.01) |
| ***F24F 11/35*** | (2018.01) |
| ***F24F 13/14*** | (2006.01) |

(52) U.S. Cl.

CPC ..... *A62C 2/247* (2013.01); *F24F 13/1426* (2013.01); *F24F 11/35* (2018.01); *F24F 2013/1433* (2013.01)

(58) Field of Classification Search

CPC ..... A62C 2/247
USPC ..... 318/3, 34
See application file for complete search history.

(56) References Cited

U.S. PATENT DOCUMENTS

| | | | | |
|---|---|---|---|---|
| 7,477,028 | B2 * | 1/2009 | Bokusky | H02P 3/02 318/273 |
| 8,760,103 | B2 * | 6/2014 | Bokusky | G05B 9/02 318/563 |
| 9,106,171 | B2 * | 8/2015 | Bartholomew | H02P 29/68 |
| 2004/0209566 | A1 | 10/2004 | Caliendo et al. | |
| 2004/0211200 | A1 | 10/2004 | McMillan et al. | |
| 2004/0212336 | A1 | 10/2004 | McMillan et al. | |
| 2013/0116834 | A1 | 5/2013 | Grabinger et al. | |

FOREIGN PATENT DOCUMENTS

WO 2014009965 A1 1/2014

OTHER PUBLICATIONS

PCT Search Report dated Dec. 8, 2015, for PCT Application No. PCT/2015/021955,16 pages.

* cited by examiner

*Primary Examiner* — David Luo

(57) ABSTRACT

An approach is that uses a first amount of energy used by a motor to open a vent and reducing the amount of energy to a second amount of energy to maintain the vent in an open position.

13 Claims, 5 Drawing Sheets

STORED ENERGY FOR FAILSAFE VALVE

FIELD OF THE INVENTION

This application relates to the field of building systems and, more particularly, to dampers and valves in an air treatment system.

BACKGROUND

Building automation systems encompass a wide variety of systems that aid in the monitoring and control of various aspects of building operation. Building automation systems (which may also be referred to herein as "building control systems") include security systems, fire safety systems, lighting systems, and heating, ventilation, and air conditioning ("HVAC") systems. Many of those systems have valves that need to be in a set position if an emergency occurs, such as a fire. For example, air vents are typically in an open or partially open position during normal operation and need to be in a closed position if a fire occurs in order to prevent smoke and fumes being transported throughout the building. As the vents are often controlled by electrical motors and power may be unreliable in an emergency, the vents need to have a way to efficiently close.

What is needed in the art is an approach that enables vents to close efficiently using stored energy.

SUMMARY

In accordance with one embodiment of the disclosure, an actuator (motor in the current example) is coupled to a switching regulator that uses a first power level to open a vent and a second lower power level to keep the vent open. The second power level having the advantage of saving energy and reducing wear on the motor and gear train associated with the vent. Energy is required to keep the vent open because it is biased to be in a closed position for safety reasons (i.e. the vent would close in the event of a fire where power to an actuator is lost).

The above described features and advantages, as well as others, will become more readily apparent to those of ordinary skill in the art by reference to the following detailed description and accompanying drawings. While it would be desirable to provide an approach for an actuator that reduces the wear and power consumption of the actuator during operation, one or more of these or other advantageous features, the teachings disclosed herein extend to those embodiments which fall within the scope of the appended claims, regardless of whether they accomplish one or more of the above-mentioned advantages.

DESCRIPTION

In certain smoke control applications it would be advantageous to position an actuator (typically controlled by a motor) to control air flow and have it return to a closed position in the event of a fire or loss of power. This type of actuator would be termed "fail-safe." An approach to store energy required to close the actuator (often a mechanical spring). An electrical motor provides the ability to position the actuator open and a biasing spring would provide the fail safe return. Upon loss of power the actuator returns to the closed position. But, while the motor is maintaining the actuator in the open position, power is being consumed. It is the objective of this approach to reduce the motor heating and gear train stress as well as power consumption. It is also advantageous to use a high frequency switcher in order to reduce ripple in order to also prevent damage to the gears over time.

Figure 1:
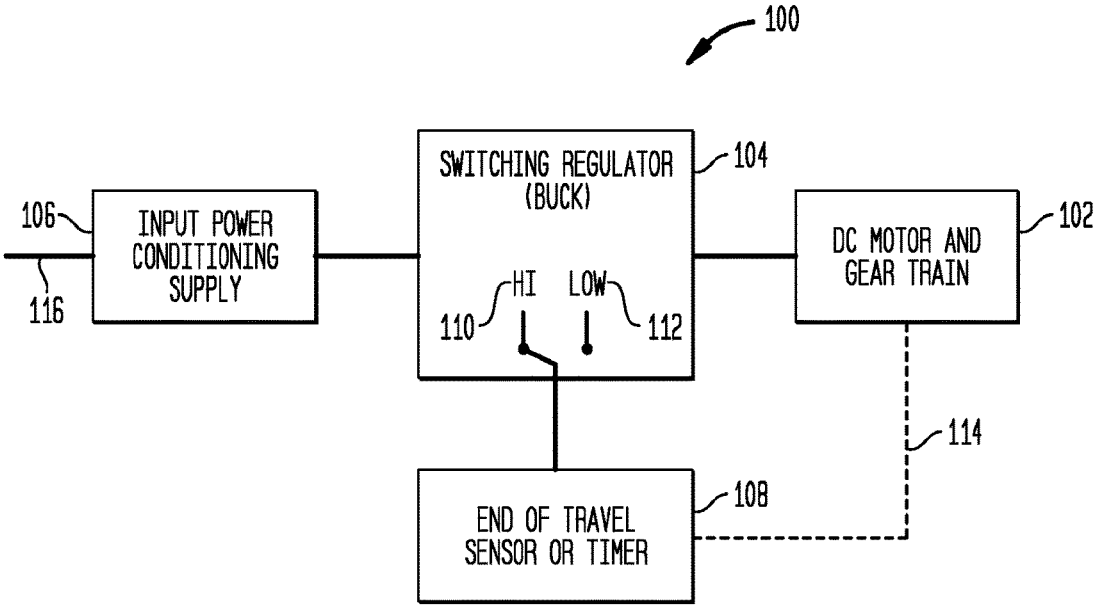
FIG. 1 is a block diagram of an example of a high temperature switching regulator supplying a two-step constant voltage to a vent motor in accordance with an example implementation of the invention.

In FIG. 1, a block diagram 100 of an example of a high temperature switching regulator supplying a two-step constant voltage to a motor in accordance with an example implementation of the invention is depicted. A direct current (DC) motor and associated gearing 102 is coupled to a damper or valve (not shown) that may reside in an air vent in a building. The voltage in an HVAC system is typically 24 volts AC (but in some implementations, an AC voltage at 120 or 240 VAC, 50-60 Hz, or 24 VDC may be employed). The DC motor 102 may be controlled and is coupled to a switching regulator 104. The switching regulator 104 is a BUCK switching regulator in the current example and is a remarkably efficient (higher efficiency than traditional linear approaches). The switching regulator 104 supplies constant voltage at one of two steps to the DC motor 102 and may be coupled to an input power conditioning supply 106 with an input voltage 116 and timer/end of travel sensor 108.

The switching regulator 104 supplies constant voltage, or more precisely a two-step constant voltage, with one step being a "HI" 110 constant voltage and the other step being a "LOW" 112 constant voltage to the motor & gear train 102. The BUCK switching regulator 104 supplies a constant "HI" voltage 110 to the motor 102 and runs the motor 102 to its end of travel (i.e. vent or valve in the open position). With the motor at its end of travel or vent open position (the open position may be before the actual end of travel of the gear train), a biasing member, such as a spring on the vent may be extended or stretched. The "HI" constant voltage 110 supplied to the motor and gear train 102 is then switched to the "LOW" current limited constant voltage 112 in order to reduce torque at the end of travel to save energy and wear on the gear train.

Once at the end of travel, the first or "HI" constant voltage 110 to the motor 102 is reduced to a second or "Low" constant voltage 112 in order to provide a minimal force to hold the motor in the current position (vent open). In the present implementation, a timer may be used to indicate when to switch between the "HI" constant voltage 110 and the "Low" constant voltage 112 occurs. The timer may be set for a predetermined amount of time and that amount of time is associated with the time it takes for the DC motor and drive train 102 to oven the vent.

In other implementations, a sensor or switch may be used to signal or otherwise trigger 114 the end of travel and a switch from "HI" constant voltage 110 to the "Low" constant voltage 112. The reduction in constant voltage reduces the heating and gear train stress as well as the power consumption of the DC motor 102. In order to achieve these results, "clean" DC power with low voltage rippling is desirable as the "clean" DC power prevents gear and motor wear from "fretting" of the gear train.

The use of a high frequency switching regulator, such as a BUCK switching regulator is superior to other approaches because it provides "cleaner" power to the motor which reduces fretting as opposed to approaches that use rectifiers. A rectifier and filtered 50/60 Hz power source may have a high degree of ripple that is difficult to filter. This ripple if not addressed, results in "fretting corrosion" of the gears and may result in premature failure, which has actually occurred with traditional approaches.

The switching regulator 104 switches from "HI" constant voltage 110 to "LOW" constant voltage 112 in response to a sensor or timer depending upon the implementation. The switching regulator 104 is a two-step voltage supply. Because a BUCK switching regulator 104 is employed, a significant savings in power is achieved over traditional approaches. Furthermore, the BUCK switching regulator 104 has the ability to be powered from either 24V AC (50 or 60 Hz) or 24V DC and may operate over a wide input voltage range without the need for a transformer as used in prior art implementations. The reduction in voltage to the motor (DC motor 102 in the current example) minimizes gear train stress.

Figure 2:
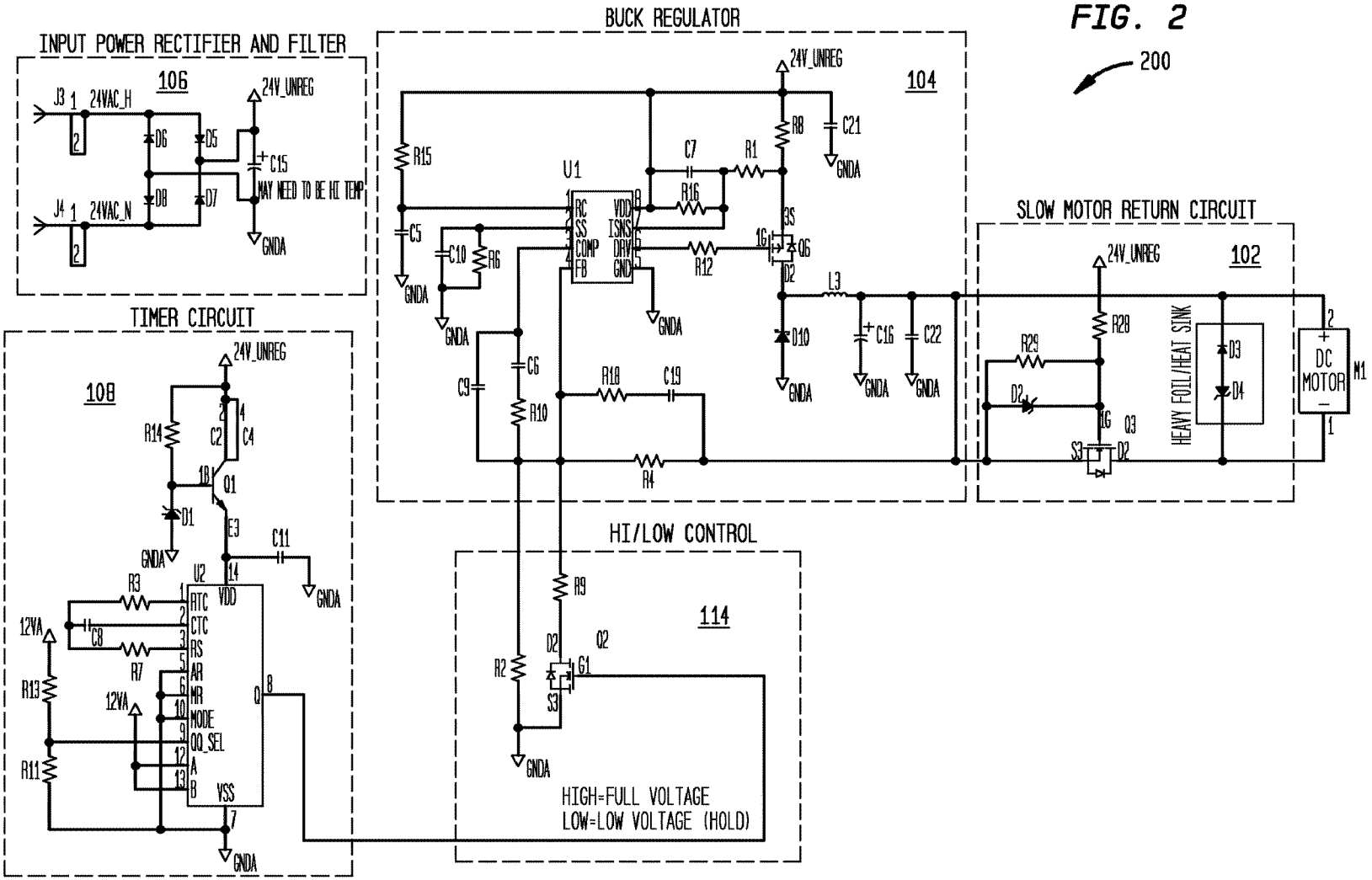
FIG. 2 is a circuit diagram of the high temperature switching regulator of FIG. 1 with two-step constant voltage in accordance with an example implementation.

Turning to FIG. 2, a circuit diagram 200 of the high temperature switching regulator 104 of FIG. 1 with two-step constant voltage in accordance with an example implementation is illustrated. The end of travel timer 108 is depicted with the "HI"/"Low" control 114. The input power 116 conditioning supply 106 is shown implemented as an input power rectifier and filter circuit. The input power conditioning supply provides power to the timer circuit 108 and the two-step switching regulator 104 (shown as a BUCK regulator). The switching from "HI" constant voltage to a "Low" constant voltage occurs in response to the timer circuit 108 via the "HI"/"Low" control 114. The DC motor and gear train 102 is shown with a circuit that reduces motor speed during return so the gears of the gear train are not damaged during operation. The DC motor and gear train 102 along with the associated circuit may be coupled to the two-step constant voltage supplied via the two-step switching regulator 104.

Figure 3:
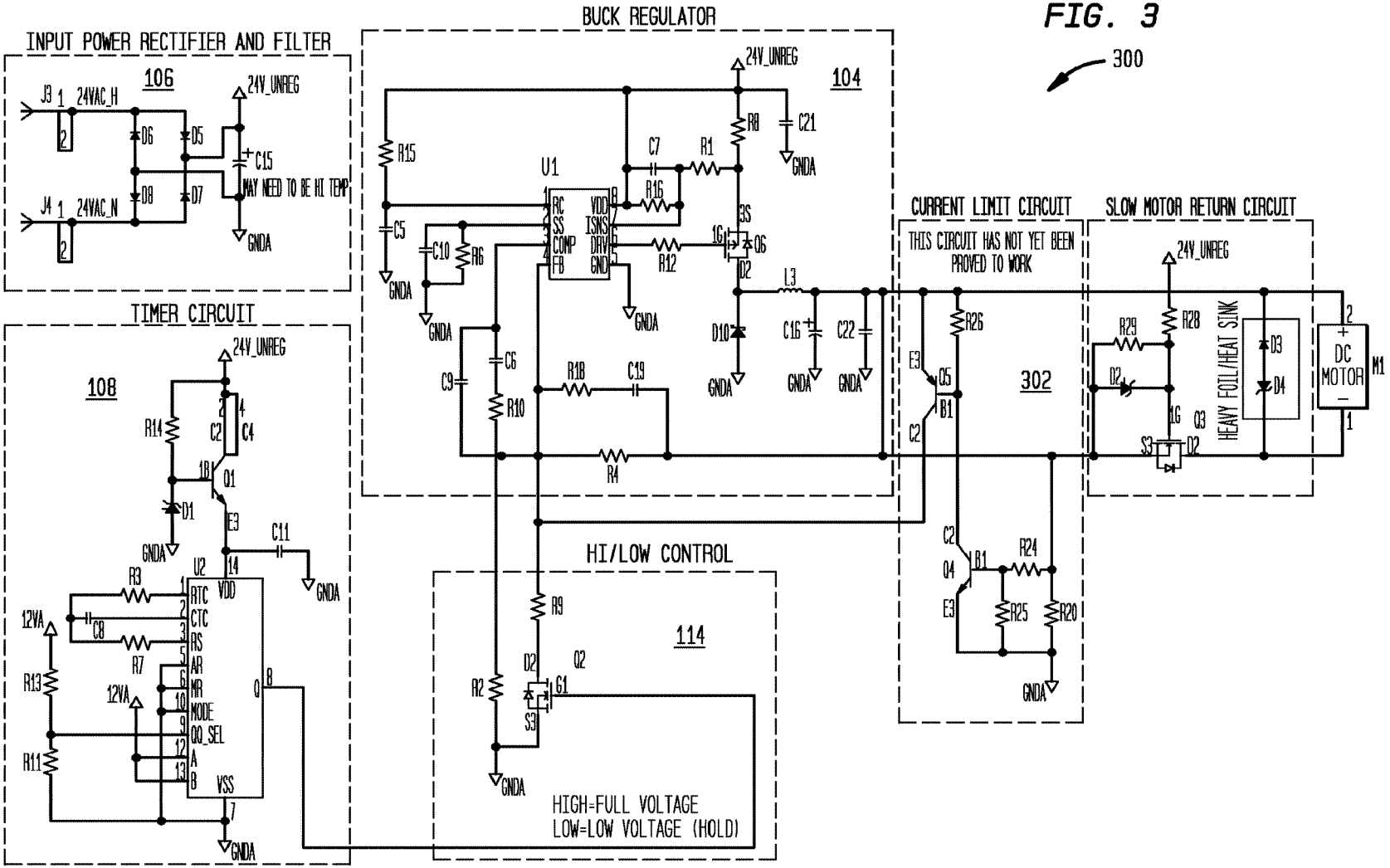
FIG. 3 is a circuit diagram of another example of a high temperature switching regulator with two-step constant voltage that is current limited in accordance with and example implementation.

In FIG. 3 another circuit diagram 300 of an example of a high temperature switching regulator 104 with two-step constant voltage of FIG. 2 along with a current limit circuit 302 in accordance with and example implementation is illustrated. In this two-step constant voltage implementation, a current limiter 302 prevents the initial current surges that results when DC motors are engaged (it is noted that in practice, a delay circuit at startup may be need for reliable operation). By preventing this surge, power is saved along with reducing the wear on the DC motor and gear train 102.

Figure 4:
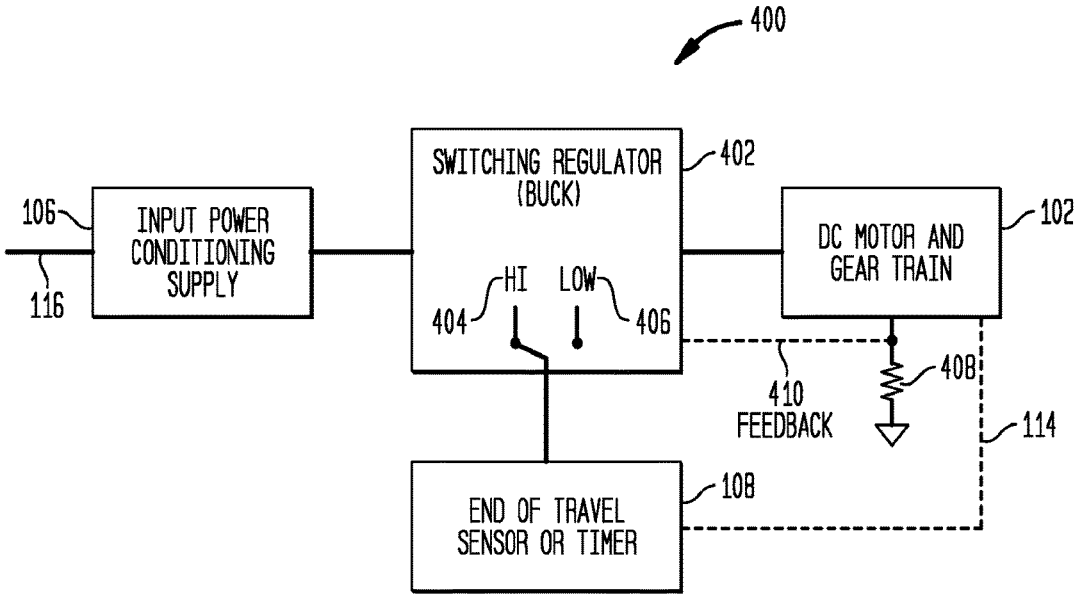
FIG. 4 is a block diagram of another example of a high temperature switching regulator with two-step constant current controlling a vent motor in accordance with an example implementation of the invention.

Turning to FIG. 4 is a block diagram 400 of another example of a high temperature switching regulator supplying a two-step constant current 402 rather than a constant voltage to a vent motor in accordance with an example implementation of the invention. The BUCK switching regulator 402 is also a voltage limited current source with two-steps, a "HI" constant current 404 and a "LO" constant current 406 for moving the vent via the DC motor and gear train 102 to an open position and holding it open. The BUCK switching regulator 402 receives power from input power conditioning supply 106 that has input voltage 116. The DC motor and gear train 102 is coupled to a current sense resistor 408 and a feedback signal 410 to the BUCK switching regulator 402 from the DC motor gear train 102. The current sense resistor 408 results in the feedback 410 being a voltage value that is proportional to the current 410. Furthermore, an end of travel sensor or switch 108 coupled to the DC motor and gear train 102 may be used to signal a "HI"/"Low" control 114 at the end of travel.

Unlike the previous implementation of FIG. 3, where it may be difficult to distinguish between the current surge for the motor 102 startup and the end of travel, the initial surge is not an issue in the constant current configuration. With the constant voltage version as shown in FIG. 1 there is a large turn on current surge. A DC motor appears as a very low resistance before it begins to turn and develop back electromagnetic field (EMF). In a constant voltage design we limit the maximum current so as not to damage the gear train at the end stop, but we must ignore the large turn on spike. But, in a constant current design, as shown in FIG. 4, the current is always constant and only the voltage varies. At turn on the voltage is automatically decreased to keep the current constant at start up. One other benefit of the two-step constant current design of FIG. 4 is that if a transformer is needed, a smaller transformer (115 or 230V step down to 24V) may be used as opposed to larger ones that have to account for the turn on surge. Since there is no high current turn on surge, the transformer may be smaller (smaller VA rating) and also much cheaper.

Figure 5:
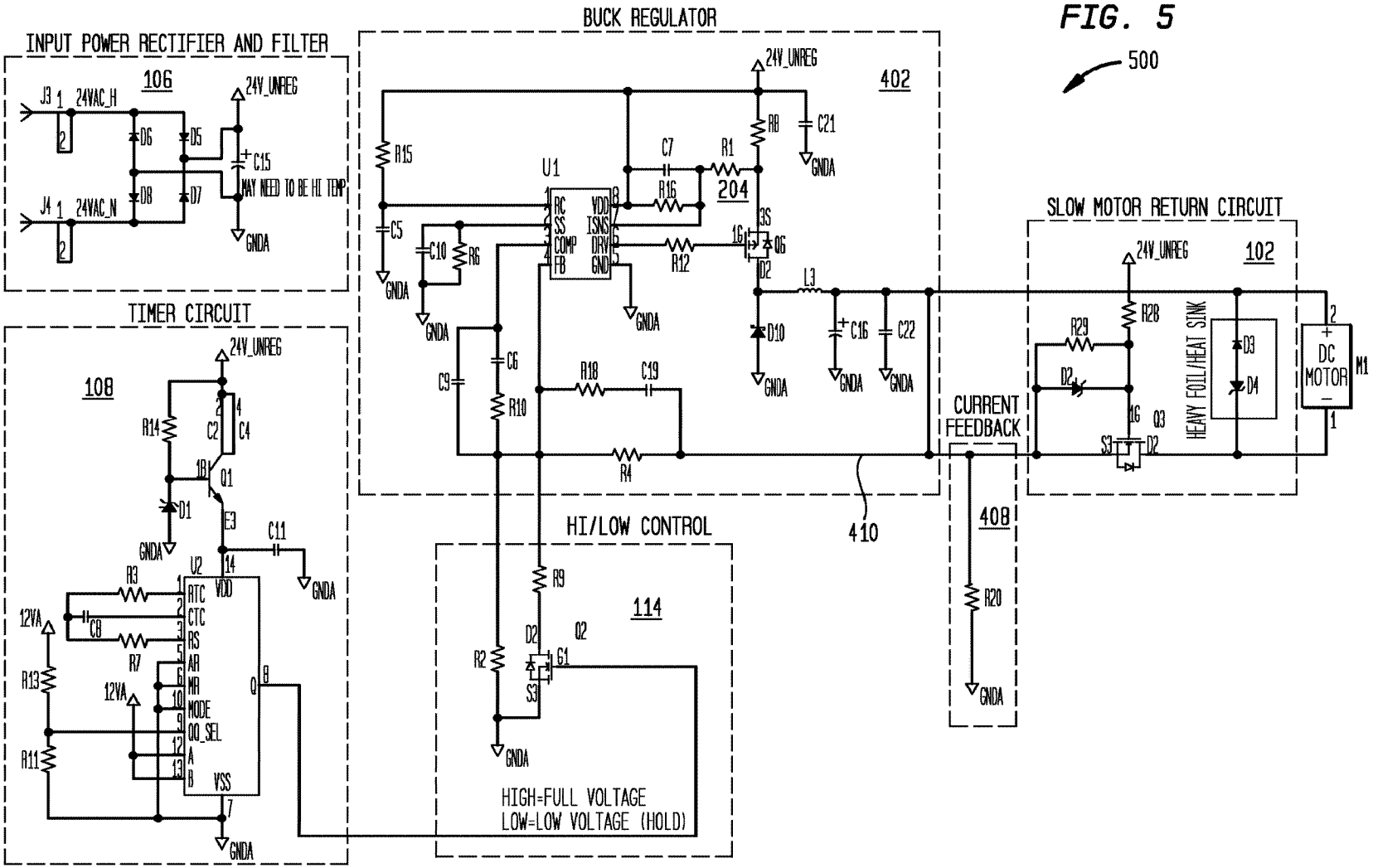
FIG. 5 is a circuit diagram of the high temperature switching regulator of FIG. 4 in accordance with an example implementation.

In FIG. 5, a circuit diagram 500 of the high temperature switching regulator 402 of FIG. 4 in accordance with an example implementation is illustrated. The input power conditioning supply 106 (input power rectifier and filter circuit) supplies power to the two-step constant current switching regulator 402 (BUCK regulator) and timer circuit 108. When activated, the timer circuit times the operation of the motor and gear train 102 and in response to the timer signals the "HI"/"Low" control 114 two switch between a "HI" constant current to a "Low" constant current. A current feedback resistor 408 is shown between the DC motor and gear train 102 and the two-step constant current switching regulator 402.

The foregoing detailed description of one or more embodiments of the stored energy for failsafe valve or damper approach has been presented herein by way of example only and not limitation. It will be recognized that there are advantages to certain individual features and functions described herein that may be obtained without incorporating other features and functions described herein. Moreover, it will be recognized that various alternatives, modifications, variations, or improvements of the above-disclosed embodiments and other features and functions, or alternatives thereof, may be desirably combined into many other different embodiments, systems or applications. Presently unforeseen or unanticipated alternatives, modifications, variations, or improvements therein may be subsequently made by those skilled in the art which are also intended to be encompassed by the appended claims. Therefore, the spirit and scope of any appended claims should not be limited to the description of the embodiments contained herein.

What is claimed is:

1. An actuator for a vent or valve comprising:

a motor that controls the operation of the vent, where the vent has an open position and a closed position and is biased toward the closed position; and a switching regulator coupled to a power supply with an input voltage and the motor where the switching regulator provides a first constant voltage to the motor when the vent changes from the closed position to the open position and a second constant voltage that maintains the vent in an open position and the first constant voltage is greater than then the second constant voltage, where the changing of the first constant voltage to the second constant voltage is in response to a timer.

2. The actuator of claim 1, where the power supply conditions the voltage supplied to the switching regulator.

3. The actuator of claim 2, where the input voltage is 24 volts direct current.

4. The actuator of claim 2, where the input voltage is 24 volts alternating current.

5. The actuator of claim 1, where the switching regulator is a two-step constant voltage switching regulator.

6. The actuator of claim 1, where the switching regulator is current limited.

7. An actuator for a vent or valve comprising:

a motor that controls the operation of the vent, where the vent has an open position and a closed position and is biased toward the closed position;

a switching regulator coupled to a power supply with an input voltage and the motor where the switching regulator provides a first constant voltage to the motor when the vent changes from the closed position to the open position and a second constant voltage that maintains the vent in an open position and the first constant voltage is greater than then the second constant voltage; and a travel sensor coupled to the switching regulator that sense when the vent is open and in response the first constant voltage is switched to the second constant voltage by the switching regulator.

8. An actuator for a vent comprising:

a motor that controls the operation of the vent, where the vent has an open position and a closed position and is biased toward the closed position; and a switching regulator coupled to the motor and a power supply with an input voltage that provides a current with a first constant current to the motor when the vent changes from the closed position to the open position and a second constant current that maintains the vent in an open position and the first constant current is greater than then the second constant current, where the changing of the first constant current to the second constant current is in response to a timer coupled to the switching regulator.

9. The actuator of claim 8, where the power supply conditions the voltage supplied to the switching regulator.

10. The actuator of claim 9, where the input voltage is 24 volts direct current.

11. The actuator of claim 9, where the input voltage is 24 volts alternating current passed through a rectifier.

12. The actuator of claim 8, where the switching regulator is a two-step constant current switching regulator.

13. An actuator for a vent comprising:

a motor that controls the operation of the vent, where the vent has an open position and a closed position and is biased toward the closed position;

a switching regulator coupled to the motor and a power supply with an input voltage that provides a current with a first constant current to the motor when the vent changes from the closed position to the open position and a second constant current that maintains the vent in an open position and the first constant current is greater than then the second constant current; and a sensor coupled to the switching regulator that sense when the vent is open and in response the first constant current is switched to the second constant current by the switching regulator.

* * * * *